US011566638B2

(12) United States Patent
Luo et al.

(10) Patent No.: US 11,566,638 B2
(45) Date of Patent: Jan. 31, 2023

(54) IMPELLER WITH IMPROVED HEAT DISSIPATION PERFORMANCE AND REDUCED NOISE AND HEAT DISSIPATION FAN HAVING THE SAME

(71) Applicant: CHAMP TECH OPTICAL (FOSHAN) CORPORATION, Foshan (CN)

(72) Inventors: Zheng Luo, Foshan (CN); Xiao-Guang Ma, Foshan (CN); Yung-Ping Lin, New Taipei (TW); Yong-Kang Zhang, Foshan (CN)

(73) Assignee: CHAMP TECH OPTICAL (FOSHAN) CORPORATION, Foshan (CN)

( * ) Notice: Subject to any disclaimer, the term of this patent is extended or adjusted under 35 U.S.C. 154(b) by 0 days.

(21) Appl. No.: 17/685,571

(22) Filed: Mar. 3, 2022

(65) Prior Publication Data

US 2022/0307519 A1 Sep. 29, 2022

(30) Foreign Application Priority Data

Mar. 26, 2021 (CN) ..... 202110328478.7

(51) Int. Cl.

| | |
|---|---|
| ***F04D 29/32*** | (2006.01) |
| ***F04D 29/66*** | (2006.01) |
| ***F04D 29/38*** | (2006.01) |

(52) U.S. Cl.
CPC ..... *F04D 29/666* (2013.01); *F04D 29/329* (2013.01); *F04D 29/384* (2013.01)

(58) Field of Classification Search
CPC .... F04D 29/384; F04D 29/666; F04D 29/329; F04D 29/324; F04D 29/667
See application file for complete search history.

(56) References Cited

U.S. PATENT DOCUMENTS

| | | | | |
|---|---|---|---|---|
| 5,603,607 | A * | 2/1997 | Kondo | F04D 29/661 415/119 |
| 10,508,662 | B2 * | 12/2019 | Nakashima | F04D 29/384 |
| 10,578,320 | B2 * | 3/2020 | Sawada | F04D 29/681 |
| 2015/0152875 | A1 * | 6/2015 | Kamiya | F04D 29/681 416/147 |

* cited by examiner

*Primary Examiner* — Sabbir Hasan
(74) *Attorney, Agent, or Firm* — ScienBiziP, P.C.

(57) ABSTRACT

A three-bladed impeller providing a cooling airflow in air, with increased heat-dissipating efficiency and reduced noise includes a hub and three blades, the blades are arranged around the hub. Each blade is arched along its axial length from the front of fan to the back and also arched radially from the hub end of each blade to the outside tip. The back edge of each blade includes first and second slots, arranged alternately, the width of each first slot is λ1, the width of each of each second slot is λ2, the comparative sizes between λ2 and λ1 are in a ratio range of 1.6:1 to 1.8:1 (λ2:λ1).

18 Claims, 3 Drawing Sheets

IMPELLER WITH IMPROVED HEAT DISSIPATION PERFORMANCE AND REDUCED NOISE AND HEAT DISSIPATION FAN HAVING THE SAME

FIELD

The subject matter herein generally relates to temperature control, and more particularly, to an impeller in a gaseous medium with improved heat dissipation performance and reduced noise and a heat dissipation fan having the impeller.

BACKGROUND

When a fan rotates around a central axis, a linear velocity of airflow at base end of each blade adjacent to a hub is less than a linear velocity of airflow at the tip of the blade away from the hub, which will cause uneven velocity distribution of airflow across the fan. As a result, the amount of airflow at the base end of the blade is less than that at the tip end of the blade.

A pressure difference may be generated at these different positions on the blade due to the difference in the amount of airflow. Such pressure difference may cause turbulence along a direction perpendicular to the central axis and prevent air continuously flowing out of the fan. The unregulated turbulence and mainstream airflow collide with each other to form a vacuum area, resulting in generation of vortexes and noise, and heat dissipation performance of the fan is reduced.

BRIEF DESCRIPTION OF THE DRAWINGS

Implementations of the present technology will now be described, by way of example only, with reference to the attached figures.

DETAILED DESCRIPTION

Figure 1:
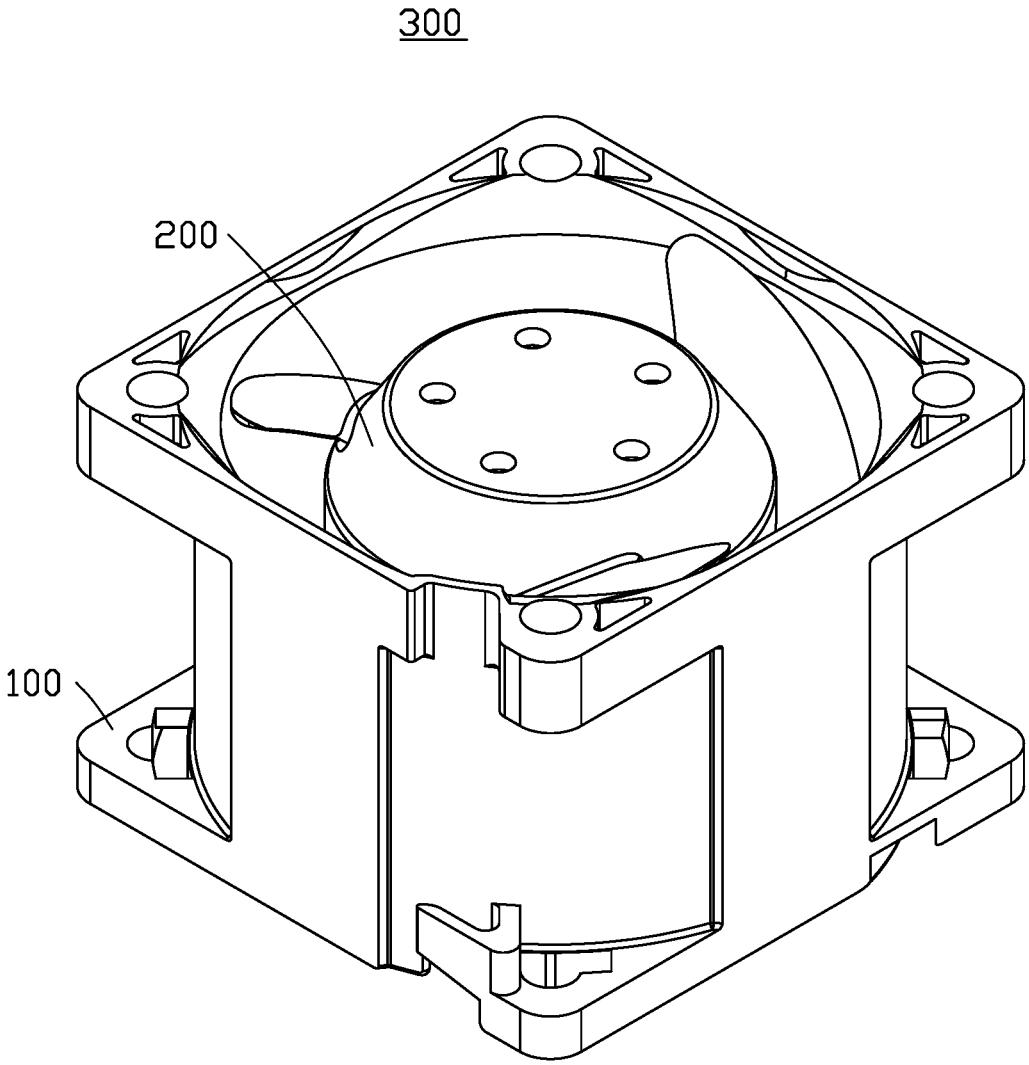
FIG. 1 is a diagrammatic view of a fan according to an embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts may be exaggerated to better illustrate details and features of the present disclosure.

The disclosure is illustrated by way of example and not by way of limitation in the figures of the accompanying drawings, in which like references indicate similar elements. It should be noted that references to "an" or "one" embodiment in this disclosure are not necessarily to the same embodiment, and such references mean "at least one."

The term "comprising," when utilized, means "including, but not necessarily limited to"; it specifically indicates open-ended inclusion or membership in the so-described combination, group, series, and the like.

Referring to FIG. 1, an embodiment of a heat dissipation fan (heat dissipation fan 300) is provided. The heat dissipation fan 300 can be used in a computer or a server for cooling. The heat dissipation fan 300 includes a base 100 and an impeller 200 arranged in the base 100.

Figure 2:
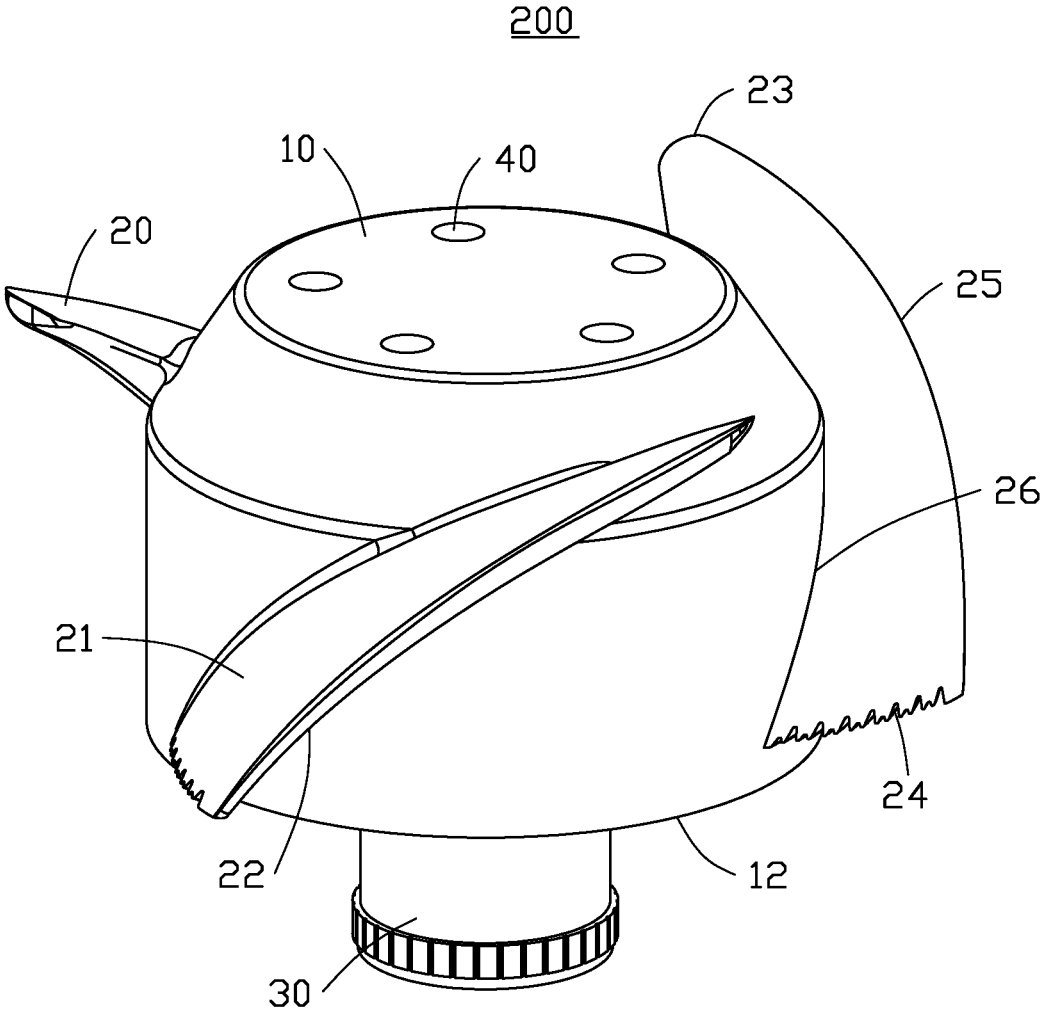
FIG. 2 is a diagrammatic view of an impeller of the heat dissipation fan of FIG. 1.
Figure 3:
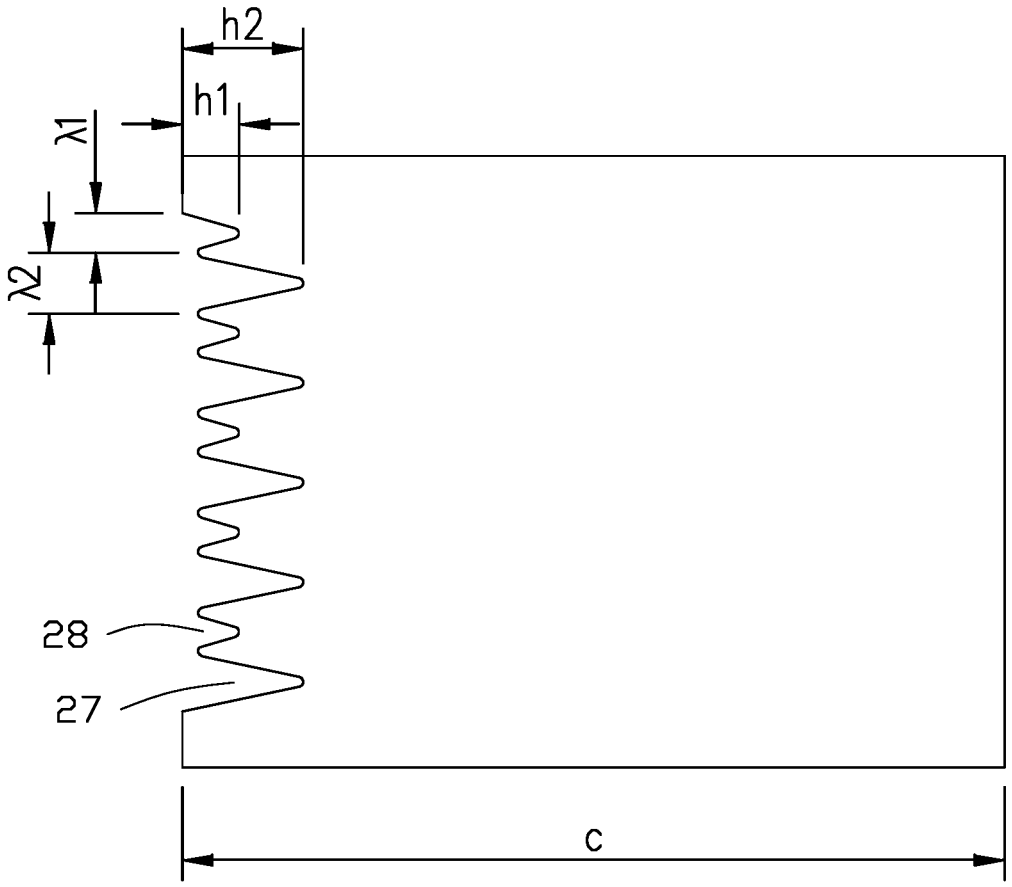
FIG. 3 is a diagrammatic view of a back edge of a blade in the impeller shown in FIG. 2.

Referring to FIGS. 2 and 3, the impeller 200 includes a hub 10, a plurality of blades 20, and a central axis 30. The hub 10 defines a central receiving groove 12, and the central axis 30 is arranged within the central receiving groove 12. An end portion of the central axis 30 away from the hub 10 connects to an external driving device (not shown), which drives the hub 10 to rotate.

Referring to FIGS. 2 and 3, the blades 20 are evenly arranged on a periphery of the hub 10. Each blade 20 includes a front edge 23 and a back edge 24 opposite to the front edge 23. The back edge 24 is provided with a plurality of first slots 28 and a plurality of second slots 27, the first slots 28 and the second slots 27 are arranged alternatively. A width of the first slot 28 is $\lambda 1$, a depth of the first slot 28 is h1, a width of the second slot 27 is $\lambda 2$, a depth of the second slot 27 is h2, a chord length of blade 20 is C, and a ratio of h2 to h1 is in a range of 1.6 to 2.8.

In this embodiment, the blade 20 also includes an outer edge 25 and an inner edge 26 opposite to the outer edge 25. The outer edge 25 and the inner edge 26 connect the front edge 23 and the back edge 24. The inner edge 26 connects to the hub 10, and the outer edge 25 faces away from the hub 10. The first slot 28 is adjacent to the outer edge 25, and the second slot 27 is adjacent to the inner edge 16. In other embodiment, the first slot 28 is adjacent to the inner edge 16, and the second slot 27 is adjacent to the outer edge 25. The outer edge 25, the inner edge 26, the front edge 23, and the back edge 24 form a propellor of air having a windward surface 21 and a leeward surface 22 opposite to the windward surface 21.

In this embodiment, each of the first slot 28 and the second slot 27 are triangular in profile. In other embodiments, the first slot 28 and the second slot 27 may also be rectangle-shaped or semicircular in shape.

When the external driving device drives the hub 10 to rotate around the central axis 30, the blades 20 are rotated. The windward surface 21 of the rotating blade 20 compresses the air to generate airflow. A portion of the airflow passes the leeward surface 23 of the blade 20 through the first slot 28 and the second slot 27, thereby decreasing the pressure difference between both side of the blade 20, so as to reduce any vortex and noise generated. When the ratio of h2 to h1 is in a range of 1.6 to 2.8, the heat dissipation performance is also improved. When the ratio is less than 1.6, the airflow is not sufficiently divided between one side of the blade 20 to other side of the blade 20, so that the pressure difference still exists, leaving vertex and noise still present. When the ratio is greater than 2.8, too much airflow goes from one side of the blade 20 to the other side of the blade 20, causing the pressure difference to decrease dramatically, and reducing the efficiency of heat dissipation of the fan 100.

When the ratio of h2 to h1 is equal to 1.6, a small amount of airflow goes through the first slot 28 and second slot 27, benefitting efficiency of heat dissipation the most but with little effect on noise generated. When the ratio of h2 to h1 is equal to 2.8, a large amount of airflow goes through the first slot 28 and the second slot 27, benefitting heat dissipation the least while reducing the noise most.

In this embodiment, three blades 20 are arranged evenly around the periphery of the hub 10, in other words, a radial angle between two neighboring blades 20 is 120°. When the radial angle of the two neighboring blades 20 is less than 120°, the airflow can be disturbed, and friction between the airflow and the blade 20 increases, lowering the heat dissipation performance. When the radial angle of two neighboring blades 20 is greater than 120°, the air pressure between the two neighboring blades 20 is decreased, which also lowers the heat dissipation performance. The arrangement of an odd number of blades 20 evenly around the periphery of the hub 10 reduces the risks of the central axis 30 failing as a central axis when rotating at a high speed.

Referring to FIG. 3, a ratio of λ2 to λ1 is in a range of 1.1 to 1.8, and a ratio of λ2 to C is in a range of 0.03 to 0.05, which improves the heat dissipation performance and also lowers the noise of the heat dissipation fan 100. For example, when the ratio of λ2 to λ1 is less than 1.1 or the ratio of λ2 to C is less than 0.03, an insufficient amount of airflow goes through the first and second slots 28 and 27, so that the pressure difference still exists, causing a vortex and noise. When the ratio of λ2 to λ1 is greater than 1.8 or the ratio of λ2 to C is greater than 0.05, an excessive amount of airflow goes through the first and second slots 28 and 27, causing the pressure difference to decrease dramatically, and the heat dissipation performance of the heat dissipation fan 100 to decrease.

Referring to FIG. 2, in this embodiment, the cross section of the blade 20 along its depth is an arc. The windward surface 21 in concave, and the leeward surface 22 is convex. In other embodiments, The windward surface 21 is convex, and the leeward surface 22 is concaved.

In this embodiment, the hub 10 is beveled like a cup at its front surface. The hub 10 defines a plurality of vents 40. The vents 40 penetrate the bottom of the central receiving groove 12, so the central receiving groove 12 communicates with an outer environment. The vents 40 are evenly arranged around the central axis 30. The vents 40 are used for transferring heat from the central receiving groove 12 to the outer environment.

In other embodiment, the blade 10 includes a stiffener (not shown), and the stiffener is arranged on an edge of the windward surface 21 or the leeward surface 22. The stiffener is used for strengthening structural integrity of the blade 20, thereby reducing the deformation of blade 20 when rotating at high speed. In other embodiments, the hub 10 includes multiple ribs (not shown), and the ribs are arranged on the inner surface of the hub 10 to increase the stability of the heat dissipation fan 300.

In this embodiment, the blade 10 is roughly part of a spiral, and arranged along the direction of the central axis 30. The inner edge 26 and the outer edge 25 are also extended in an arc, thus there is an arc in each of two dimensions, meaning that there is an arc from inner edge 26 to outer edge 25 and an arc from front edge 23 to back edge 24. This reduces friction between air and the blade 20, thereby increasing the amount of airflow and the heat dissipation performance. In other embodiments, the blade 20 may also be arranged along a direction perpendicular to the central axis 30.

Thus a connection region between the front edge 23 and the outer edge 25 is arc-shaped, and a connection region between the back edge 24 and the inner edge 26 is also arc-shaped. The arc shape connection regions reduce drag of the high-speed rotating blade 10 and increase the performance of the heat dissipation fan 300. In other embodiment, the connection region between the front edge 23 and the outer edge 25 may include a corner-shape.

It is to be understood, even though information and advantages of the present embodiments have been set forth in the foregoing description, together with details of the structures and functions of the present embodiments, the disclosure is illustrative only; changes may be made in detail, especially in matters of shape, size, and arrangement of parts within the principles of the present embodiments to the full extent indicated by the plain meaning of the terms in which the appended claims are expressed.

What is claimed is:

1. An impeller with improved heat dissipation performance and reduced noise comprising:

a hub;

a plurality of blades arranged around and connected to the hub; each of the plurality of blades comprising a front edge and a back edge opposite to the front edge, the back edge comprising a plurality of first slots and a plurality of second slots alternately arranged, wherein a width of each of the plurality of first slots is λ1, a width of each of the plurality of second slots is λ2, a ratio of λ2 to λ1 is in a range of 1.6 to 1.8.

2. The impeller of claim 1, wherein a depth of each of the plurality of first slots is h1, a depth of each of the plurality of second slots is h2, and a ratio of h2 to h1 is in a range of 1.1 to 1.8.

3. The impeller of claim 1, wherein a chord length of each of the plurality of blades is C, and a ratio of λ2 to C is in a range of 0.03 to 0.05.

4. The impeller of claim 1, wherein each of the plurality of blades comprises a windward surface and a leeward surface opposite to the windward surface, the windward surface is concaved, and the leeward surface is convex.

5. The impeller of claim 1, further comprising a central axis, wherein the hub comprises a receiving groove, and the central axis is arranged in the receiving groove.

6. The impeller of claim 5, wherein the hub comprises a plurality of vents, each of the plurality of vents penetrates a bottom of the hub, and the plurality of vents surrounds the central axis.

7. The impeller of claim 1, wherein each of the plurality of blades comprises an inner edge and an outer edge opposite to the inner edge, the inner edge connects to the hub, and the inner edge and the outer edge connect between the front edge and the back edge.

8. The impeller of claim 7, wherein each of the plurality of blades is spiral-shaped, and the inner edge and the outer edge are both arc-shaped.

9. The impeller of claim 7, wherein a connection region between the front edge and the outer edge is arc-shaped, and a connection region between the back edge and the inner edge is arc-shaped.

10. A heat dissipation fan comprising:

a base;

an impeller arranged in the base, the impeller comprising:

a hub;

a plurality of blades arranged around and connected to the hub; each of the plurality of blades comprising a front edge and a back edge opposite to the front edge, the back edge comprising a plurality of first slots and a plurality of second slots alternately arranged, wherein a width of each of the plurality of first slots is λ1, a width of each of the plurality of second slots is λ2, a ratio of λ2 to λ1 is in a range of 1.6 to 1.8.

11. The heat dissipation fan of claim 10, wherein a depth of each of the plurality of first slots is h1, a depth of each of the plurality of second slots is h2, and a ratio of h2 to h1 is in a range of 1.1 to 1.8.

12. The heat dissipation fan of claim 10, wherein a chord length of each of the plurality of blades is C, and a ratio of λ2 to C is in a range of 0.03 to 0.05.

13. The heat dissipation fan of claim 10, wherein each of the plurality of blades comprises a windward surface and a leeward surface opposite to the windward surface, the windward surface is concaved, and the leeward surface is convex.

14. The heat dissipation fan of claim 10, further comprising a central axis, wherein the hub comprises a receiving groove, and the central axis is arranged in the receiving groove.

15. The heat dissipation fan of claim 14, wherein the hub comprises a plurality of vents, each of the plurality of vents penetrates a bottom of the hub, and the plurality of vents surrounds the central axis.

16. The heat dissipation fan of claim 10, wherein each of the plurality of blades comprises an inner edge and an outer edge opposite to the inner edge, the inner edge connects to the hub, and the inner edge and the outer edge connect between the front edge and the back edge.

17. The heat dissipation fan of claim 16, wherein each of the plurality of blades is spiral-shaped, and the inner edge and the outer edge are both arc-shaped.

18. The heat dissipation fan of claim 16, wherein a connection region between the front edge and the outer edge is arc-shaped, and a connection region between the back edge and the inner edge is arc-shaped.

* * * * *